US011530364B2

(12) United States Patent
Kim

(10) Patent No.: US 11,530,364 B2
(45) Date of Patent: Dec. 20, 2022

(54) LUBRICANT COMPRISING SPHERICAL GRAPHITE NANOPARTICLES

(71) Applicant: Hongwoo Lee, Gyeongsan-si (KR)

(72) Inventor: Young Il Kim, Boryeong-si (KR)

(73) Assignee: Hongwoo Lee, Gyeongsan-si (KR)

( * ) Notice: Subject to any disclaimer, the term of this patent is extended or adjusted under 35 U.S.C. 154(b) by 0 days.

(21) Appl. No.: 17/294,897

(22) PCT Filed: Nov. 20, 2019

(86) PCT No.: PCT/KR2019/015961
§ 371 (c)(1),
(2) Date: Dec. 10, 2021

(87) PCT Pub. No.: WO2020/106061
PCT Pub. Date: May 28, 2020

(65) Prior Publication Data

US 2022/0119725 A1 Apr. 21, 2022

(30) Foreign Application Priority Data

Nov. 20, 2018 (KR) ..... 10-2018-0143769

(51) Int. Cl.

| | |
|---|---|
| ***C10M 125/02*** | (2006.01) |
| ***C10M 169/04*** | (2006.01) |
| *C10N 30/00* | (2006.01) |
| *C10N 20/06* | (2006.01) |
| *C10N 40/02* | (2006.01) |
| *C10N 40/25* | (2006.01) |

(52) U.S. Cl.
CPC ..... *C10M 125/02* (2013.01); *C10M 169/04* (2013.01); *C10M 2201/041* (2013.01); *C10M 2203/003* (2013.01); *C10N 2020/06* (2013.01); *C10N 2030/50* (2020.05); *C10N 2040/02* (2013.01); *C10N 2040/25* (2013.01)

(58) Field of Classification Search
CPC ..... C10M 169/04; C10M 2201/041; C10M 2203/003; C10N 2020/06; C10N 2030/50; C10N 2040/25
See application file for complete search history.

(56) References Cited

U.S. PATENT DOCUMENTS

2004/0209782 A1* 10/2004 Zhang ..... C10M 169/04 508/113
2005/0079354 A1 4/2005 Iijima et al.
(Continued)

FOREIGN PATENT DOCUMENTS

JP 2003-206120 7/2003
KR 10-2008-0086401 9/2008
(Continued)

OTHER PUBLICATIONS

International Search Report dated Mar. 3, 2020 in corresponding PCT/KR2019/015961, 2 pages.
(Continued)

*Primary Examiner* — Ellen M Mcavoy
(74) *Attorney, Agent, or Firm* — Hovey Williams LLP

(57) ABSTRACT

The present invention relates to an engine oil containing, as a bearing particle, 0.1 g to 2 g of spherical graphite particles having an average diameter of 1 nm to 300 nm per liter, and an additive composition therefor.

6 Claims, 6 Drawing Sheets

(56) References Cited

U.S. PATENT DOCUMENTS

| | | | | |
|---|---|---|---|---|
| 2005/0124504 | A1* | 6/2005 | Zhang | B82Y 30/00 508/113 |
| 2008/0287326 | A1* | 11/2008 | Zhang | C10M 103/02 508/113 |
| 2008/0312111 | A1* | 12/2008 | Malshe | C10M 169/04 508/172 |
| 2010/0022422 | A1* | 1/2010 | Wu | C10M 163/00 508/130 |
| 2011/0046027 | A1* | 2/2011 | Zhamu | C10M 103/02 977/734 |
| 2012/0103183 | A1 | 5/2012 | Jung et al. | |
| 2013/0005619 | A1 | 1/2013 | Lee et al. | |
| 2017/0009171 | A1* | 1/2017 | Soto-Castillo | C10M 169/04 |
| 2017/0145338 | A1* | 5/2017 | Yong | C10M 141/06 |

FOREIGN PATENT DOCUMENTS

| | | |
|---|---|---|
| KR | 10-2011-0108081 | 10/2011 |
| KR | 10-2012-0016109 | 2/2012 |
| KR | 10-2014-0011627 | 1/2014 |

OTHER PUBLICATIONS

Machine Translation of KR10-2008-0086401, 15 pages.
Machine Translation (Abstract Only) of KR10-2014-0011627, 1 page.

* cited by examiner

[Fig. 1]
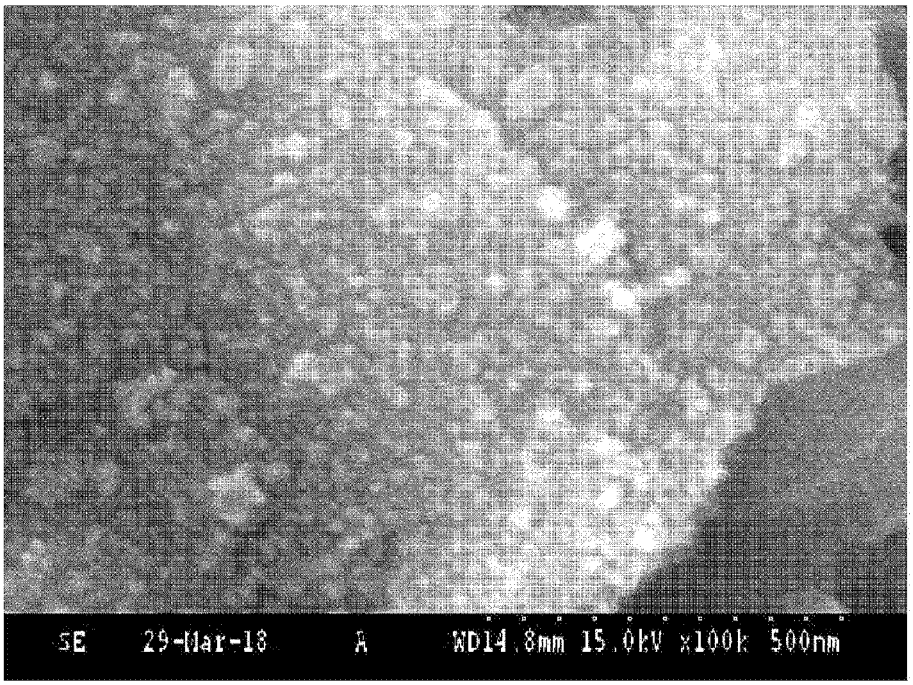

[Fig. 2]
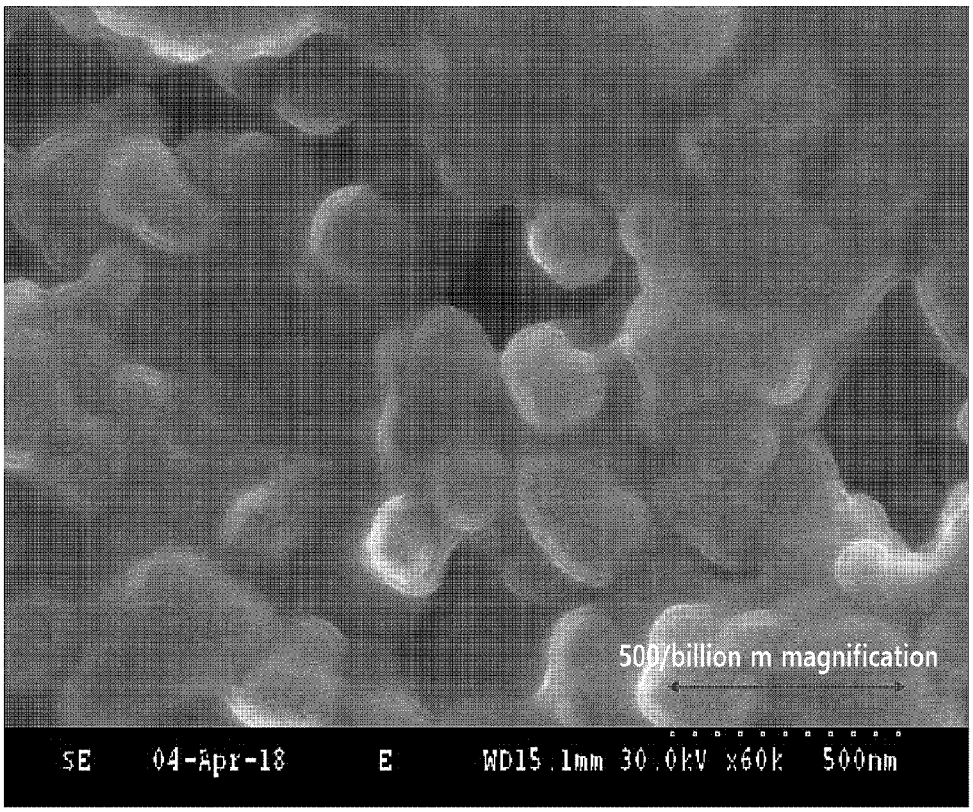

[Fig. 3]
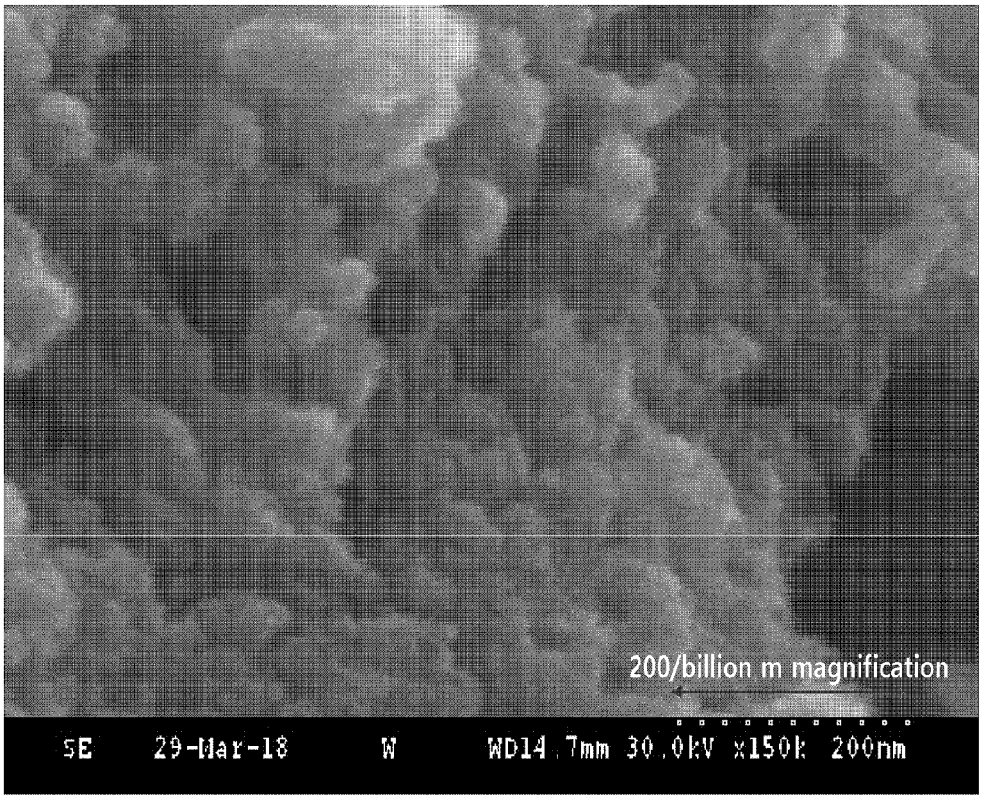

[Fig. 4]
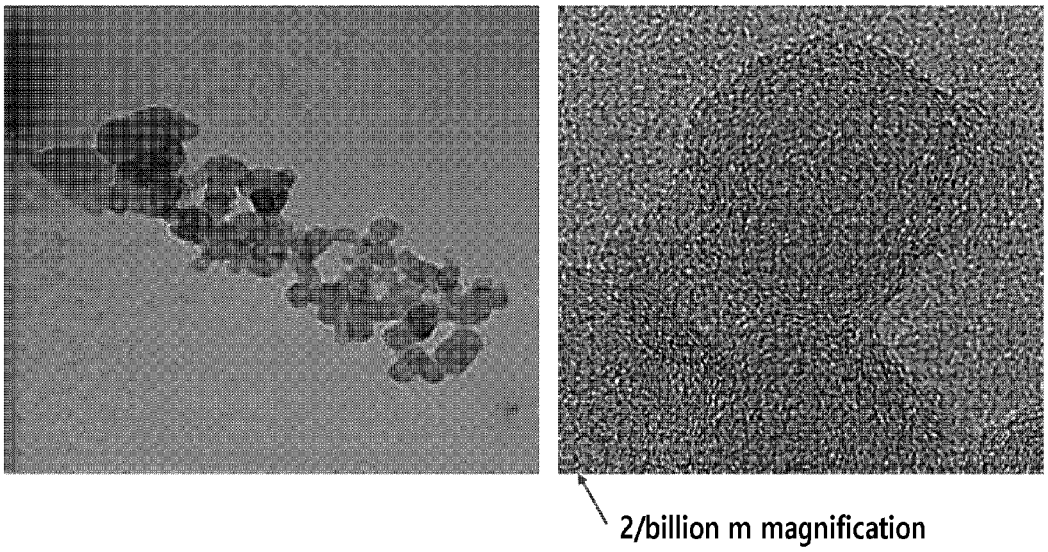
[Fig. 5]
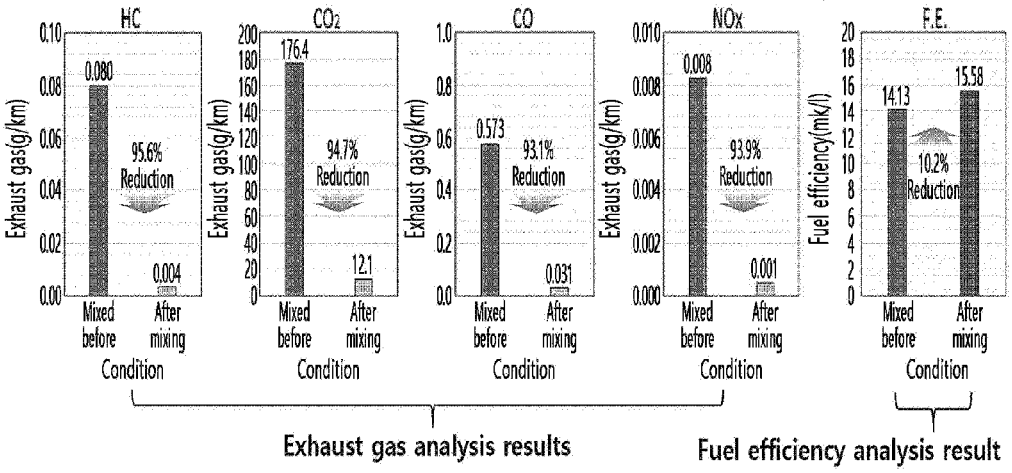

[Fig. 6]
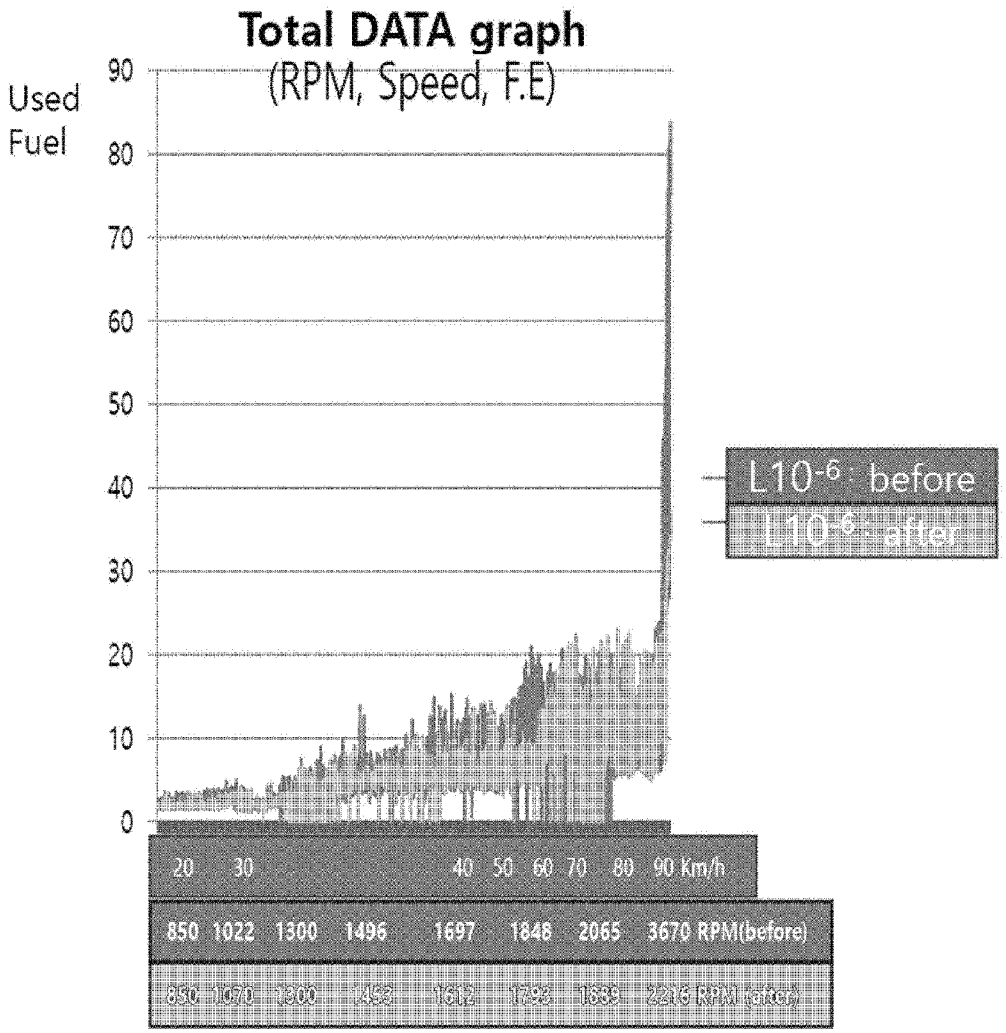

[Fig. 7]
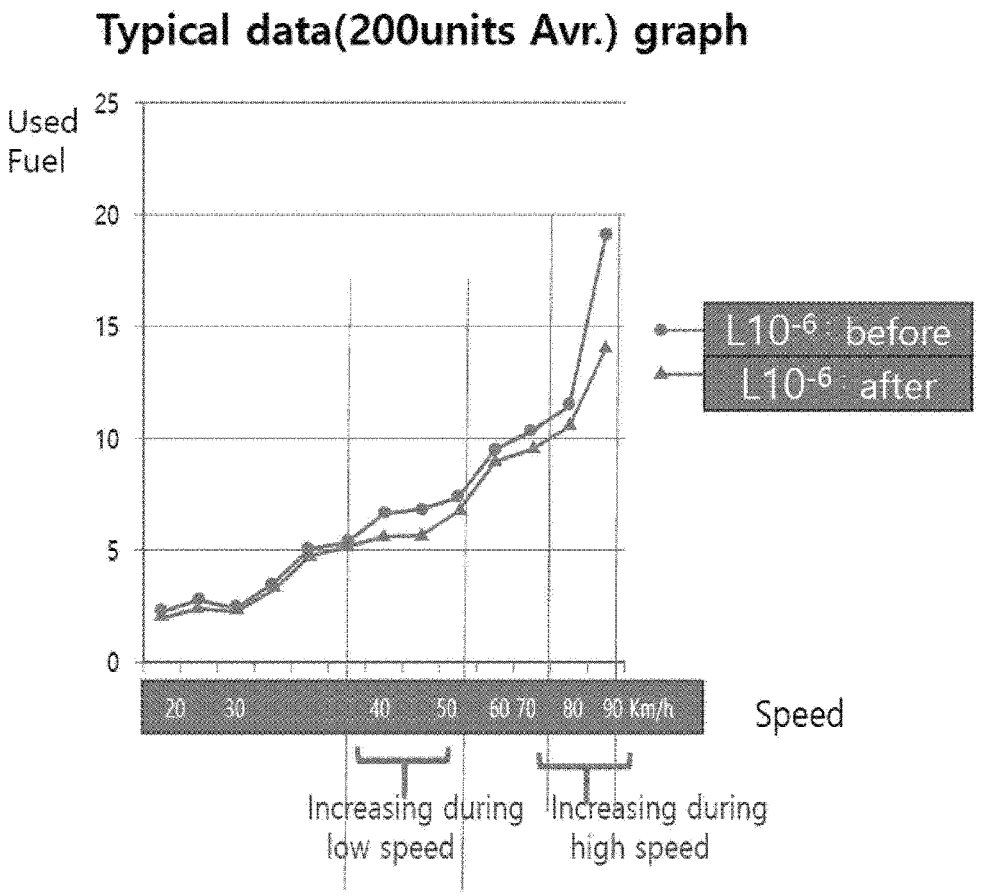

LUBRICANT COMPRISING SPHERICAL GRAPHITE NANOPARTICLES

RELATED APPLICATIONS

This application claims priority to PCT International Patent Application No. PCT/KR2019/015961, filed Nov. 20, 2019, which claims the priority benefit of Korean Patent Application No. 10-2018-0143769, filed Nov. 20, 2018. Each of these applications is hereby incorporated by reference in their entireties.

TECHNICAL FIELD

The present invention relates to an engine oil containing, as a bearing particle, 0.1 g to 2 g of spherical graphite particles having an average diameter of 1 nm to 300 nm per liter, and an additive composition therefor.

BACKGROUND ART

Engine oil is a lubricating oil used in internal combustion engines and contains a hydrocarbon mixture as a main component. Since the inside of the engine is at high temperature, the hydrocarbon mixture can be easily oxidized, and thus, an antioxidant, a detergent dispersant, or the like can be mixed with refined lubricating oil for use. The hydrocarbon mixture suitable for the engine oil should not boil at a relatively high temperature and should be able to maintain a liquid state even at low temperatures. As these requirements are difficult to meet using a single hydrocarbon compound alone, many types of hydrocarbon-based additives are mixed to produce engine oils with melting and boiling points that meet the above specifications. When the engine oil is hardened, the engine cannot be protected, whereas when the oil is evaporated and becomes gas, the engine may be burned together with fuel, which may impair the engine. Therefore, climate characteristics should be taken into consideration when composing a hydrocarbon mixture.

These engine oils play various roles in the engine, including 1) lubrication, 2) cooling, 3) providing airtightness, 4) buffering, 5) rust-prevention, and 6) purification.

Lubrication serves to form an oil film between various metal components in the engine to minimize friction and thereby help smooth operation of the components and prevent abrasion. Meanwhile, a large amount of heat is generated inside the engine in which explosive combustion reactions of fuel continue to occur. Therefore, if there is no function of cooling by the engine oil, the metal engine may easily be melted or deformed, and therefore, the cooling function of the engine oil, which maintains the temperature appropriately, is necessary. The engine oil, which has been heated by absorbing heat inside the engine, can be used repeatedly as it exchanges heat along the reservoir and circulation passage and maintains the appropriate temperature. Airtightness means sealing a gas or liquid in a container to prevent leakage. The engine generates a force through the movement of a piston inside the cylinder. The piston is made slightly smaller than the inner diameter of the cylinder, so there is naturally a small gap between the cylinder and the piston, and pressure can be released through the gap. Accordingly, these pressure leaks can be prevented by the airtightness-providing action of the engine oil. For example, when the piston moves up and down inside the cylinder, the engine oil fills the gap to reduce friction between the cylinder and the piston and prevent pressure from escaping during combustion, expansion, and stroke. Additionally, the engine oil may form an oil film in the gap between the components in the engine, thereby acting as a buffer to prevent damage to the metal components due to the strong force when the engine corn busts. Further, the oil film formed by such engine oil can provide a rust-proofing function which prevents these components, which are metals, from being oxidized by exposure to oxygen and moisture and thereby generating rust. Furthermore, the engine oil is refined such that it may be filtered by a filter while circulating inside of the engine by carrying impurities, which are the various combustion and corrosion residues produced by abrasion between the components, and which are inevitably produced inside the engine despite the buffering and rust-proofing actions. Thus, damage to the engine can be minimized.

Therefore, the engine oil must maintain an appropriate viscosity to allow sufficient airtightness-providing and buffering actions in the engine operated at high temperature and high speed, considering that the viscosity of the liquid decreases as the temperature increases. In contrast, the viscosity must be sufficiently low such that it does not freeze and enables starting of the engine even when the temperature drops in the winter, and accordingly, it is preferred that the change in viscosity with respect to temperature is small; that is, a high viscosity index is preferred. In addition, once a replacement is made, it can be used for several months to even a few years, and due to such characteristic, the oxidation may occur due to lack of durability of the oil itself due to long-term use. In particular, the oxidation may be promoted due to the presence of heat, pressure, moisture, and metals which are all present during driving of the engine, resulting in the generation of acidic substances and sludges, and accordingly, the engine oil deteriorates. In severe cases, it may lose its function as an engine oil. In particular, the engine oil should have excellent oxidation stability as it can be easily oxidized by being exposed to high temperatures during operation. Furthermore, a good engine oil should have good detergent dispersibility so as to wash and disperse unnecessary materials. As described above, in order to prevent sediments and/or deposits produced by deterioration and incorporation of contaminants when using the engine oil from being bound or deposited inside the engine, the engine oil may preferably have detergent dispersibility, and this can be achieved by using additives such as detergent dispersants. Lastly, the engine oil can cause corrosion inside the engine due to acid substances, moisture, and oxides generated during the combustion process, and generate rust, and thus, it should have the ability to suppress such actions. Additionally, impurities formed in the engine operation part can damage the metal surface, and the oil film of the part subjected to high load may be destroyed, and thus, it is necessary to prevent abrasion by mixing an additive that strengthens the adhesion to the metal surface and the film.

In addition to the common elements described above, there are engine oil requirements that are particularly required according to the type of engine, and additives for engine oils capable of achieving the respective functions have been developed to satisfy various needs.

Meanwhile, as the prevalence of automobiles is increasing, there have been reports of deaths due to excessive emission of environmental pollution, especially fine dust, caused by excessive emission of exhaust gas. Therefore, the European Union is predicting the phasing out of diesel engine vehicles. In Korea, exhaust gas-reduction projects are being implemented. Specifically, vehicle owners who are subject to low-pollution regulations of cities and provinces according to the provisions of Article 58 of the Air Quality Preservation Act must follow the standards set by the cities and provinces. The owners of a specific diesel vehicle that exceeds the emission standard must have it re-inspected within the re-inspection period, or it must be mounted with an emission reduction device or converted to a low-pollution engine (LPG) within one month of the expiration of the specific diesel vehicle inspection period, or old vehicles should be scrapped in advance. As such, the current method of reducing exhaust gas emissions is to mount a device that reduces the exhaust gas, such as diesel particulate filter (DPF), diesel oxidation catalyst (DOC), and selective catalytic reduction catalysts (SCR), which incurs additional cost. It is known that when the DPF corresponding to the first type of reduction device is mounted, the reduction efficiency appears to be about 80%.

DISCLOSURE

Technical Problem

The present inventors have diligently researched to find an additive for an engine oil that can significantly reduce exhaust gas emissions without using a separate reduction device, and which can improve fuel efficiency. As a result, they have confirmed that when an engine oil containing, as a bearing particle, spherical graphite particles having an average diameter of 1 nm to 300 nm is used, the exhaust gas emissions can be reduced by 90% or more, and also, the fuel efficiency can be improved by 10% or more, compared to the case of using engine oils not containing the same, thereby completing the present invention.

Technical Solution

One object of the present invention relates to an engine oil containing, as a bearing particle, 0.1 g to 2 g of spherical graphite particles having an average diameter of 1 nm to 300 nm per liter.

Another object of the present invention relates to an additive composition for an engine oil containing, as a bearing particle, spherical graphite particles having an average diameter of 1 nm to 300 nm.

Advantageous Effects

In the present invention, when an engine oil added with spherical graphite, which has a predetermined size and density and can be evenly dispersed in oil, is used, these particles serve as bearing particles. Thus, it is possible to exhibit an exhaust gas reduction efficiency of 90% or more without mounting a separate exhaust gas reduction device and provide fuel efficiency improved by 10% or more.

BRIEF DESCRIPTION OF DRAWINGS

FIG. 1 is a diagram showing an SEM image of spherical graphite nanoparticles which are dispersed in a general water system and used as an additive for an engine oil according to an embodiment of the present invention.

FIGS. 2 and 3 are diagrams showing SEM images measured at different magnifications of spherical graphite nanoparticles which are dispersed in an engine oil and used as an additive for an engine oil according to an embodiment of the present invention.

FIG. 4 is a diagram showing a high-resolution TEM image of spherical graphite nanoparticles which are used as an additive for an engine oil according to an embodiment of the present invention.

FIG. 5 is a diagram showing the amount of exhaust gas and fuel efficiency measured when using an engine oil containing or not containing spherical graphite nanoparticles according to an embodiment of the present invention.

FIG. 6 is a diagram showing a combination of the total collected data of fuel consumption (one-time fuel injection amount expressed in mcc) according to the driving speed when using an engine oil containing or not containing spherical graphite nanoparticles according to an embodiment of the present invention.

FIG. 7 is a diagram showing the average of 200 representative data points of fuel consumption (one-time fuel injection amount expressed in mcc) according to the driving speed when using engine oil containing or not containing spherical graphite nanoparticles according to an embodiment of the present invention.

DETAILED DESCRIPTION OF PREFERRED EMBODIMENTS

The first aspect of the present invention provides an engine oil containing, as a bearing particle, 0.1 g to 2 g of spherical graphite particles having an average diameter of 1 nm to 300 nm per liter.

The second aspect of the present invention provides an additive composition for an engine oil, containing, as a bearing particle, spherical graphite particles having an average diameter of 1 nm to 300 nm.

Additionally, the present invention provides a use of an additive composition for an engine oil containing, as a bearing particle, spherical graphite particles having an average diameter of 1 nm to 300 nm.

Hereinafter, the present invention will be described in detail.

As used herein, the term "bearing" refers to a machine element that reduces friction between moving parts, and is a machine (component) that enables free movement by supporting a rotating or reciprocating shaft at a fixed position. For example, the design of the bearing freely provides the movement of the linear moving part and rotation around a fixed axis. In addition, by limiting the vertical force of the vector, the burden of movement is prevented. Many bearings also minimize friction to facilitate the desired motion as much as possible, and reduce energy loss and heat generation due to friction, preventing damage to the components.

Even when an oil film is formed on the piston and the cylinder wall of the engine by using the engine oil, direct friction therebetween cannot be excluded. Meanwhile, the engine oil of the present invention contains a suitable amount of spherical graphite particles having an average diameter of 1 nm to 300 nm evenly dispersed in a liquid oil, so that these particles are inserted between the piston and the cylinder wall to act as a bearing, thereby reducing the friction therebetween.

Meanwhile, when the compression ratio in the internal combustion engine during combustion is high, the thermal efficiency is high and the fuel consumption low. Therefore, when the engine oil according to the present invention is used, the spherical graphite particles having an average diameter of 1 nm to 300 nm in the engine oil during combustion in the internal combustion engine serve as a bearing, reducing the friction between the components of the internal combustion engine, and thus, the compression pressure of the cylinder is not deteriorated, and an appropriate amount of fuel is injected, so that the fuel and air can be mixed smoothly to produce high output through complete combustion. Accordingly, the engine performance, power, and fuel efficiency can be improved, even when a low air:fuel ratio (A:F ratio) is applied. Such an improvement of the fuel efficiency can increase the distance that can be driven with the same amount of fuel, and thus the exhaust gas emission is fundamentally reduced in proportion. Further, since the amount of heat generated in the piston can be reduced due to a decrease in friction when using the engine oil according to the present invention, it is possible to inhibit the generation of $NO_x$ oxides generated at high temperatures.

Viscosity is a measure of a fluid's resistance to flow, and is affected by temperature. In the case of gases, the viscosity increases as the temperature increases, but in liquids, the viscosity decreases as the temperature increases.

In a specific embodiment of the present invention, a commercial engine oil (Kixx Da 10W-30) having a viscosity of 140 at room temperature was used. Accordingly, the engine oil added with the spherical graphite particles according to the present invention showed an increase in viscosity within about 10. This reduces the viscosity of the engine oil in the vehicle as the engine overheats when the car is driving at a high speed, which may result in inducing the effect of reducing the degree of the viscosity of the engine oil through the heat dissipation effect due to the graphite particles and the effect of preventing overheating due to the decrease in friction of the engine.

The present invention provides an engine oil containing, as bearing particles, 0.1 g to 2 g of spherical graphite particles having an average diameter of 1 nm to 300 nm per liter. In particular, since the graphite particles have a specific gravity of 1.9 to 2.3, the graphite particles may be maintained evenly dispersed in the base oil of the engine oil.

The engine oil of the present invention contains spherical graphite particles, and thus, the improvement in the engine efficiency may be expected due to the bearing effect. Meanwhile, when the graphite particles are smaller than 1 nm in diameter, they may not have sufficient strength, decreasing durability, and the bearing effect cannot be continuously exhibited. For example, fullerenes, which are another type of spherical carbon particle, are a very expensive material and thus economically infeasible. Further, it may not exhibit a bearing effect because the particle size is also smaller than 1 nm. In contrast, when the particle size exceeds 300 nm, the number of particles that can be contained in an engine oil is limited due to their size, considering that the particle must be included at a predetermined number density in order to achieve an appropriate bearing effect. When particles are added in a large amount so as to achieve a desired number density, they can no longer be dispersed evenly in the engine oil and may aggregate and precipitate.

For example, the engine oil containing the spherical graphite particles of the present invention can improve the engine output and reduce the exhaust gas emissions compared to engine oils not containing the spherical graphite particles having an average diameter of 1 nm to 300 nm. According to a specific embodiment of the present invention, when the graphite particles are contained by driving an engine in which spherical graphite particles are added or not added to a commercial engine oil, it was confirmed that the exhaust gas emission was reduced by more than 90%; specifically, the emissions of hydrocarbons, carbon dioxide, carbon monoxide, and nitrogen oxides were reduced by more than 90%, and fuel efficiency was improved by more than 10%.

Additionally, the present invention provides an additive composition for an engine oil containing, as a bearing particle, spherical graphite particles having an average diameter of 1 nm to 300 nm.

Further, the present invention provides a use of an additive composition for an engine oil containing, as a bearing particle, spherical graphite particles having an average diameter of 1 nm to 300 nm.

The engine oil is the same as described above.

The composition may further include a surfactant and/or a dispersant for promoting the dispersion of the particles in the engine oil, and it may further include detergents, antioxidants, friction modifiers, anti-wear agents, extreme pressure (EP) additives, emulsifiers, anti-foaming agents, viscosity index improvers (viscosity regulators), pour point depressant, rust inhibitors, corrosion inhibitors, and the like, which are generally added to engine oils, but is not limited thereto.

MODE FOR CARRYING OUT THE INVENTION

Hereinafter, the present invention will be described in more detail by way of Examples. However, these Examples are provided for illustrative purposes only, and the scope of the invention is not intended to be limited to or by these Examples.

Example 1: Preparation of Engine Oil Containing Spherical Graphite Nanoparticles as Additives First, after ball milling using ethanol as a solvent for 10 days, the particles were selected using centrifugation, and graphite nanoparticles prepared by selecting only particles of 300 nm or less were used. An engine oil prepared by dispersing spherical graphite nanoparticles (1-100 nm graphite, Hongwoo Co., Ltd.) having an average diameter of 10 nm to 70 nm in a colloidal state was prepared in an amount of 0.5 g per 1 L as described above. As the engine oil, a commercial engine oil (Kixx Da, SAE viscosity of 10W-30, GS Caltex) was used, and the same engine oil without the spherical graphite nanoparticles was used as a control. The microstructure of the spherical graphite used in the present invention was observed by SEM and TEM, and the results are shown in FIGS. 1 to 4.

Example 2: Effect of Reducing Exhaust Gas by Additives

A dynamo test was performed based on the IM240 mode according to the international standard specifications to measure exhaust gas emissions and analyze fuel efficiency. Hyundai cars loaded with a 2014 gasoline engine of 1600 cc were used for the experiment. The measured result is shown in FIG. 5. Specifically, the amounts of hydrocarbons (HC), carbon dioxide ($CO_2$), carbon monoxide (CO), and nitrogen oxides ($NO_x$) contained in the exhaust gas were measured separately. As shown in FIG. 5, the amounts of the four components were all reduced by more than 90% compared to the case when the engine oil containing no additives was used, and the fuel efficiency, that is, the mileage per liter, was increased by more than 10%.

Example 3: Effect of Reducing RPM at High Speed by Additives

A dynamo test was performed based on the IM240 mode according to the international standard specification, and thousands of sets of raw data were analyzed to measure the change in RPM according to the speed, and the results are shown in FIG. 6. As shown in FIG. 6, as a result of arranging the data before and after the addition of the additives based on the vehicle driving speed, the RPM after the injection was improved as compared with before the injection of the additives. The degree of the improvement was insignificant at low speed, but the degree of the improvement of RPM was significantly increased at high speed.

In order to effectively analyze the data, 200 data points according to the vehicle driving speed were averaged and analyzed, and the results are shown in FIG. 7. As shown in FIG. 7, the data before and after the addition of the additives were not significantly different at low speeds, particularly up to about 30 km/h, but an increase in the difference of fuel consumption was observed from thereafter up to about 55 km/h. At speeds above about 70 km/h, the difference was significantly increased, and thus, the increase in RPM according to increasing driving speed upon addition of additives was significantly reduced.

The invention claimed is:

1. An engine oil containing, as a bearing particle, 0.1 g to 2 g of spherical graphite particles having an average diameter of 1 nm to 300 nm per liter.

2. The engine oil of claim 1, wherein the spherical graphite particle has a specific gravity of 1.9 to 2.3.

3. The engine oil of claim 1, wherein the engine oil improves engine output and reduces exhaust gas emissions compared to engine oils not containing spherical graphite particles having an average diameter of 1 nm to 300 nm.

4. The engine oil of claim 1, wherein the engine oil reduces emission of hydrocarbons, carbon dioxide, carbon monoxide, and nitrogen oxides by 90% or more in exhaust gas compared to engine oils not containing spherical graphite particles having an average diameter of 1 nm to 300 nm.

5. An additive composition for an engine oil containing, as a bearing particle, spherical graphite particles having an average diameter of 1 nm to 300 nm.

6. The additive composition for an engine oil of claim 5, wherein the spherical graphite particle has a specific gravity of 1.9 to 2.3.

* * * * *